United States Patent [19]

Schneeberger

[11] 4,052,840

[45] Oct. 11, 1977

[54] APPARATUS FOR SEVERING AND OVERLAPPING MATERIAL WEB SECTIONS, ESPECIALLY FOR A PACKAGING MACHINE FOR TOBACCO PRODUCTS

[75] Inventor: Ernst Schneeberger, Neuchatel, Switzerland

[73] Assignee: Molins Limited, London, England

[21] Appl. No.: 701,949

[22] Filed: July 1, 1976

[30] Foreign Application Priority Data

July 4, 1975 Switzerland ..... 8761/75

[51] Int. Cl.[2] ..... B65B 41/18; B26D 7/06

[52] U.S. Cl. ..... 53/389; 83/88

[58] Field of Search ..... 53/389; 83/88

[56] References Cited

U.S. PATENT DOCUMENTS

| | | | |
|---|---|---|---|
| 3,274,870 | 9/1966 | Schmermund | 53/389 X |
| 3,367,221 | 2/1968 | Schmermund | 53/389 X |
| 4,019,413 | 4/1977 | Davis et al. | 83/88 |

FOREIGN PATENT DOCUMENTS

| | | |
|---|---|---|
| 1,099,441 | 12/1961 | Germany |
| 2,407,767 | 8/1975 | Germany |

*Primary Examiner*—Travis S. McGehee
*Attorney, Agent, or Firm*—John C. Smith, Jr.

[57] ABSTRACT

An apparatus for severing sections of a material web and for overlapping in each case two such sections, especially for a packaging machine for tobacco products, in particular products which can be smoked, comprising a supply roll, a withdrawal device for the material web, a cutter device and a conveyor device for the sections. Between the cutter device and the conveyor device there is arranged a holder device which is coupled with a control device. The holder device is arranged in such a manner that it fixedly holds a cut section which is to be overlapped until the continuously further traveling material web end has advanced over the fixedly held section by an amount corresponding to the overlapping width.

18 Claims, 10 Drawing Figures

APPARATUS FOR SEVERING AND OVERLAPPING MATERIAL WEB SECTIONS, ESPECIALLY FOR A PACKAGING MACHINE FOR TOBACCO PRODUCTS

BACKGROUND OF THE INVENTION

The present invention relates to a new and improved construction of apparatus for the cutting or severing of sections of a material web and for overlapping in each case two such sections, especially for a packaging machine for tobacco products, in particular products which can be smoked. More specifically, the apparatus of this development is of the type comprising a supply roll, a withdrawal device for the material web, a cutter device and a conveyor device for the sections.

An apparatus of the previously mentioned type is already known to the art for a packaging machine for cigarettes. This prior art apparatus possesses an acceleration device which, for the purpose of overlapping the material web sections, briefly accelerates the payed-off portion of the material web and then again brakes the same. This mode of operation is associated with a gamut of decisive drawbacks since the acceleration and deceleration of the material web propogates to the supply roll and hence the latter likewise must be accelerated and decelerated. This limits the output of such a machine since with increased output the acceleration and deceleration forces become so large that the material web can tear. Apart from the foregoing, this piece of equipment is extremely complicated in design in order to be able to continually bring about such periodic acceleration and deceleration of the material web. This is particularly also the case with regard to the construction of the cutter or severing device which at least partially must carry out the cutting of the material web selections during the acceleration or deceleration. Now in order to be able to accomplish a cut extending at rightangles to the direction of travel of the material web, the cutters or knives require a complicated mounting and guiding so as to guarantee for an accommodation of the cutter movement to the continually changing speed of the material web. Hence, the state-of-the-art apparatus is not only limited in its output, but complicated in construction and accordingly prone to breakdown and functional disturbances.

SUMMARY OF THE INVENTION

Hence, it is a primary object of the present invention to provide an improved construction of apparatus of the previously mentioned type which is not associated with the aforementioned drawbacks and limitations of the prior art.

Another and more specific object of this invention aims at the provision of a new and improved construction of apparatus for separating or cutting and overlapping material web sections in an extremely efficient, reliable and positive manner.

Still a further object of this invention is concerned with apparatus of the previously mentioned type which is relatively simple in construction and design, extremely reliable in operation, and requires a minimum of maintenance and servicing.

Now in order to implement these and still further objects of the invention, which will become more readily apparent as the description proceeds, the apparatus of the previously mentioned type is manifested by the features that a holder device which is operatively coupled with a control device is located between the cutter device and the conveyor device. The holder device is arranged between such cutter device and conveyor device in a manner that for overlapping a cut section it holds the latter fixed for such length of time until the continuously further moving material web end has advanced over the fixedly held section by an amount corresponding to the overlapping width.

The apparatus of this development affords decisive advantages. Due to the stopping of the already cut material web section for overlapping two sections there is dispensed with the need for continually accelerating and decelerating the material web which is to be payed-off. Hence, no continually changing large forces are applied to the web, with the result that the withdrawal of the material web can occur at considerably greater speed than heretofore possible. Consequently, it is also possible to construct the cutter device more simply since it need only be adjusted to a material web which is payed-off at constant speed. As a result, there can be used cutters or knives which need not carry out any complicated movements, and thus, can be arranged rigidly or fixedly at a rotating holder. There is thus realized a very simple construction of the apparatus, resulting not only in a saving in cost but also reducing wear. Apart from the foregoing the apparatus of the invention can be operated at increased speed, resulting in a notable improvement in its output or efficiency.

A particularly simple constructional manifestation of holder or holding device can be realized if the same possesses a suction nozzle located to bound at the plane of travel of the material web. The suction nozzle has a nozzle opening directed towards the material web. In this way there is realized a particularly simple fixation or holding of the material web section. It is of advantage if the suction nozzle is provided at the infeed side of the material web with an infeed portion directed away from the material web, this infeed portion bending back the held end of the section, so that there is facilitated the infeed of the material web end. The holding or holder device possesses an extremely simple construction if its holding or retention force is greater than the friction force of the conveyor device acting upon the section. In this case the conveyor device can travel with constant speed and the section drags or slides over the conveyor element of the conveyor throughout the duration that there is held the section. However, the section can also be brought into engagement with the conveyor device by lifting-off a counter-holder.

A particularly advantageous construction of drive and an especially advantageous control device for the holder device can be realized if there is used a pneumatic system. Thus, the control device can possess, for instance, a slide valve or slide cooperating with the drive component of the apparatus, this slide valve possessing a connection channel which can be opened for the purpose of holding the section, this connection channel being located between the holding or holder device, especially the suction nozzle, and a negative pressure or vacuum source. It is of advantage if the slide valve furthermore possesses a vent channel in order to vent the suction nozzle to atmosphere following the holding function, and thus favoring the release of the material web.

It is beneficial if the conveyor device possesses a counter-holder which presses the material web and the section, respectively, against conveyor elements of the conveyor device and can be raised at least during the overlapping operation. The counter-holder enhances an exact feed or conveying of the material web and improves the cutting of the section.

The apparatus of the invention can be employed for different purposes, but is however particularly suitable for packaging machines and especially those used for packaging tobacco products, in particular products which can be smoked, and which prior to insertion into their final package are folded into a foil. As a general rule such foil consists of two parts, the second part being shorter and for instance covering the mouth portion — in the case of filter cigarettes the filters — of cigarettes and must be removed upon opening the package.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
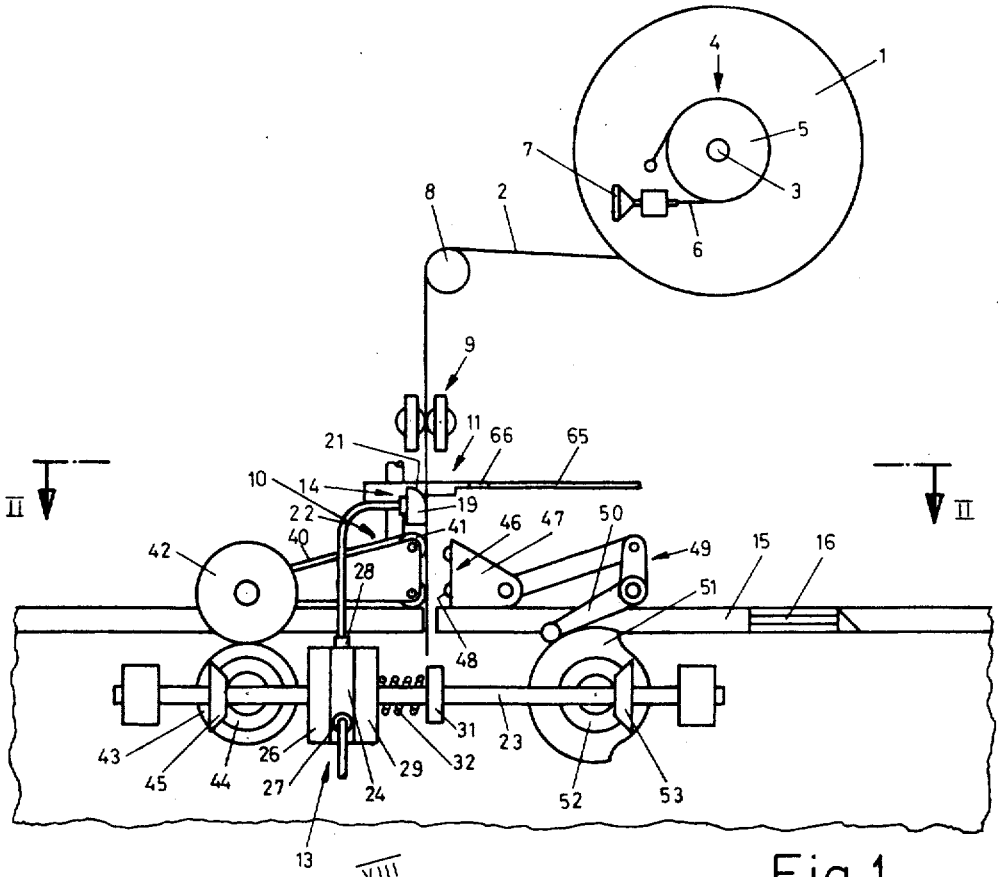
FIG. 1 is a schematic illustration in side view of apparatus for cutting sections from a material web and for in each case overlapping two sections, the apparatus being illustrated by way of example as part of an installation for packaging a stack of cigarettes.
Figure 2:
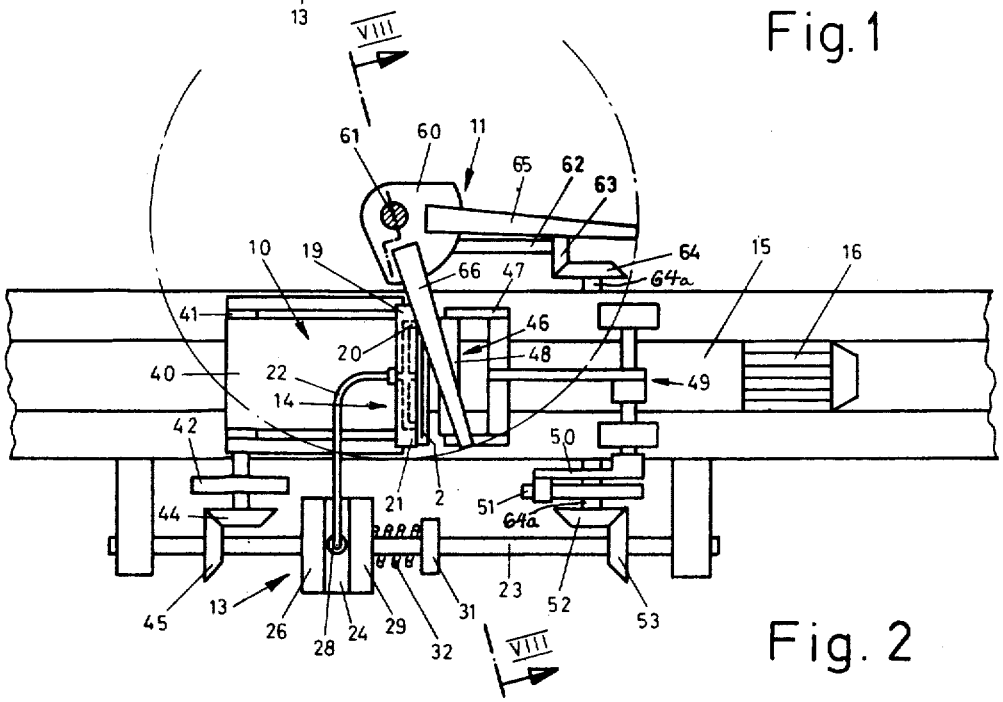
FIG. 2 is a cross-sectional view of the arrangement of FIG. 1, taken substantially along the line II—II thereof.

Described now the drawings, FIGS. 1 and 2 schematically illustrate details of an apparatus for cutting sections from a material web and for overlapping in each instance two sections, which apparatus is shown by way of example as part of an installation for packaging a cigarette stack. The apparatus embodies a supply roll or roller 1 for paying-off a material web 2 or the like, which in the embodiment under discussion is assumed to be an aluminum foil. This supply roll 1 is exchangeably seated upon a mandrel 3 and cooperates with a brake mechanism or device 4 serving for tensioning the material web 2 which is to be payed-off. To this end a steel band 6 is placed over a brake drum 5, the contact force of the steel band 6 can be varied by means of an adjustment or regulating screw 7 or the like. The material web 2 is guided over a deflecting roller 8 to a withdrawal device 9 which continually withdraws the material web 2 from the supply roll 1. The material web 2 finally arrives at a conveyor device 10. Between the withdrawal device 9 and the conveyor device 10 there is arranged a cutter device 11 which can cut sections from the material web 2 with the aid of a cutter or knife, the details of which will be discussed more fully hereinafter. Between the cutter device 11 and the conveyor device 10 there is arranged a holder device 14 which is coupled with a control device 13. This holder device 14 is arranged in such a manner that for the purpose of overlapping a cut section it holds the latter fixed for such length of time until the continuously further advancing material web end has moved over the fixedly held section by an amount corresponding to the overlapping width. Thereafter the holding or holder device 14 releases the section and such together with the overlapped portion can be further conveyed. The sections of the material web serve for packaging a cigarette stack 16 delivered along a conveyor trough 15 or the like.

Figure 3:
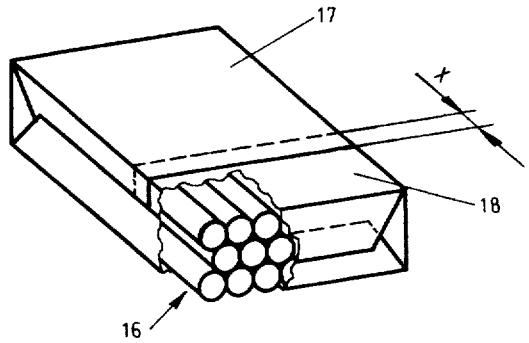
FIG. 3 is a perspective view of two material web sections folded for packaging a stack of cigarettes.
Figure 4:
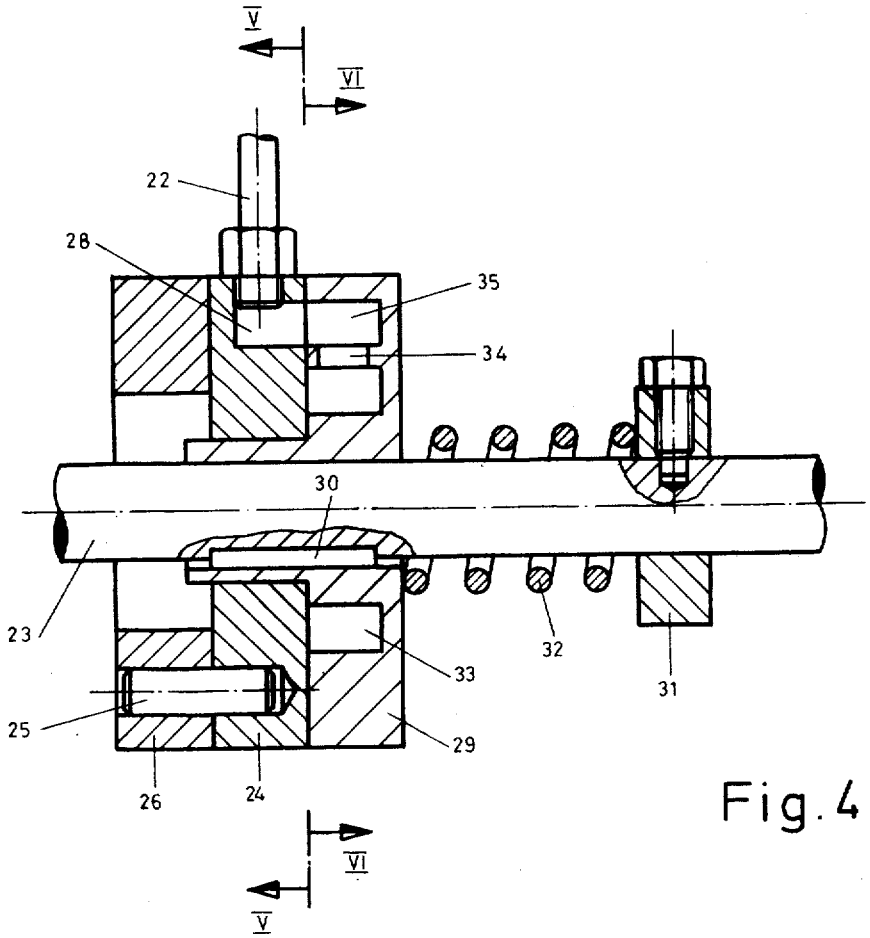
FIG. 4 is a longitudinal sectional view of the control device of the holder device.
Figure 5:
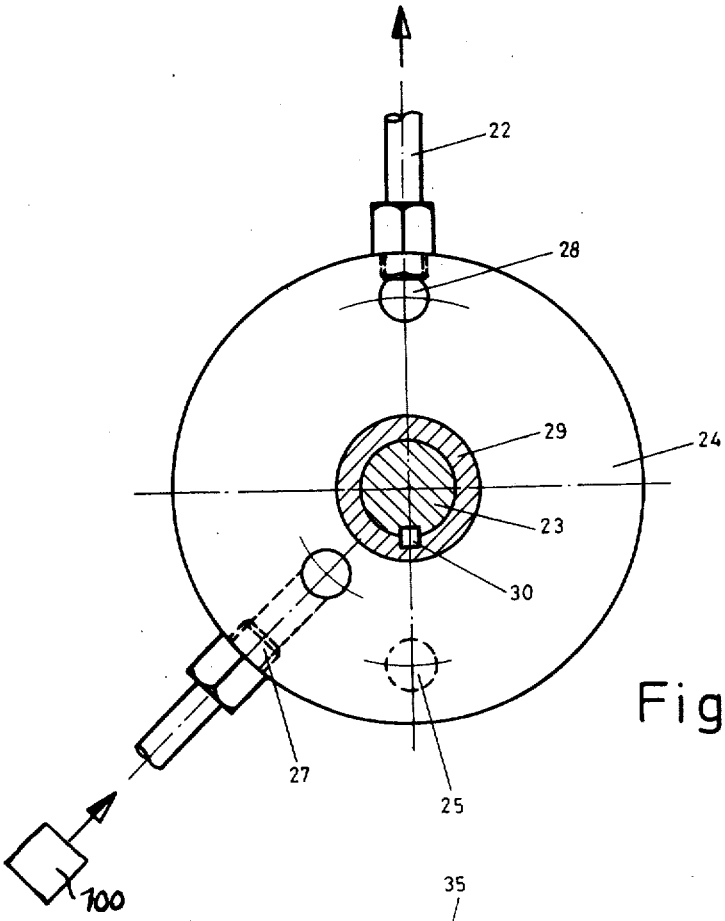
FIG. 5 is a cross-sectional view of the control device of FIG. 4, taken substantially along the line V—V thereof.
Figure 6:
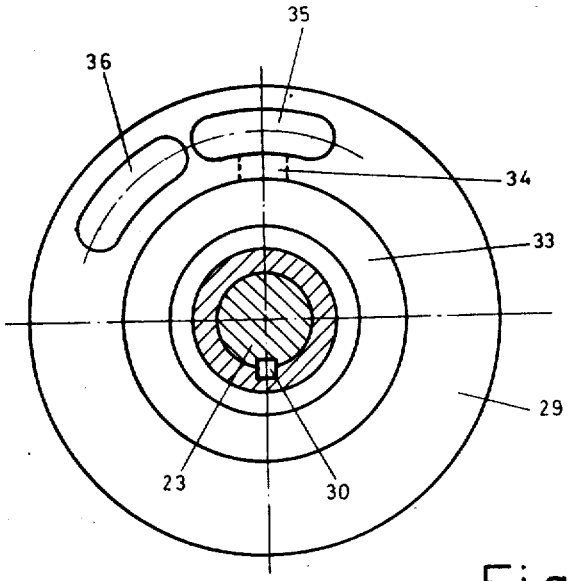
FIG. 6 is a cross-sectional view of the control device of FIG. 4, taken substantially along the line VI—VI thereof.

FIG. 3 is a perspective view portraying packaging of a cigarette stack 16 by means of the cut sections of the material web. It will be seen that a longer section 17 serves to enclose most of the cigarette stack 16 with the exception of a small portion which is covered by a short section 18. The long section 17 and the short section 18 are mutually overlapped by an amount X constituting the overlapping width.

As best seen by referring to FIGS. 1 and 2, the holder device 14 embodies a suction nozzle 19 disposed adjacent the plane of travel of the material web 2. This suction nozzle 19 has nozzle openings 20 directed towards such material web. At the infeed side of the material web 2 the suction nozzle 19 possesses an infeed component or portion 21 which is directed away from the material web and against which bears the fixedly held material web section upon application of a negative pressure or vacuum in order to facilitate the infeed of the continuously traveling material web end. The holding or retention force of the holder device 14 is greater than the frictional force of the conveyor device 10 which acts upon the section, so that the section is retained and drags or slides over the further traveling conveyor device 10. A conduit 22 leads from the suction nozzle 19 to the control device 13.

The control device 13 is seated upon a drive shaft 23 of the apparatus and is constructed as a rotary slide valve or rotary slide arrangement. The rotary slide valve embodies a stationary slide component 24 which is secured against rotation via a pin 25 at a holder 26 which, in turn, is attached to the machine frame. The stationary slide component 24 contains a connection 27 for a schematically illustrated vacuum source 100 which may be of conventional design, and a connection 28 at which there is connected the conduit 22 leading to the suction nozzle 19. Cooperating with the stationary slide component 24 is a rotating slide component 29 which is connected for rotational movement with the drive shaft 23 by means of an adjusting spring 30 or equivalent structure. A compression spring 32 bearing at a stop 31 connected with the drive shaft 23 presses the rotating slide component 29 against the stationary slide component 24 in order to insure for a functionally reliable coaction of the slide components. The rotating slide component or slide valve component 29 contains an annular or ring-shaped channel 33 which, during rotation of the rotatable or rotating slide component, is continually in flow communication with the connection 27 for the vacuum source. A connection opening 34 constitutes a passageway to an arcuate-shaped connection channel 35 which, during the rotation of the rotating slide component 29 can be periodically brought into operable connection with the connection 28 which is coupled via the conduit 22 with the suction nozzle 19. The rotating slide valve component or slide component 29 further contains an arcuate-shaped vent channel 36 which is arranged to trail the connection channel 35 viewed in the direction of rotation. The vent channel 36, during the rotation of the rotating slide component 29, likewise is periodically connected with the connection 28. Since the vent channel 36 opens into the atmosphere when the same is positioned to coincide with the connection 28 it flow communicates the suction nozzle 19 with the atmosphere.

At this point there will be considered details of the conveyor device 10. The same contains a conveyor band 40 or equivalent structure which is guided over the rollers 41. At least one of the rollers 41 is operatively connected via the spur gears 42, 43 and the bevel gears 44 and 45 with the drive shaft 23. The conveyor band 40 is guided adjacent the plane of travel of the material web 2 partially parallel to the material web and merges directly at the suction nozzle 19 of the holder device 14. The conveyor device 10 further contains a counter-holder 46 which presses the material web 2 i.e. the section of the material web against the conveyor band 40 and can be raised or lifted at least during the overlapping operation. To this end the counter-holder 46 is provided with contact or pressing rollers 48 or equivalent structure mounted in a carriage 47. The carriage 47 is actuated by means of a lever drive or transmission 49 possessing an entrainment arm 50 engaging with a cam disk 51 which, in turn, is driven by the drive shaft 23 through the intermediary of bevel gears 52, 53. Moreover, the counter-holder 46 contains a revolving band which possesses raised portions for conveying the material web and depressions for the non-positive conveying of the material web.

Figure 7:
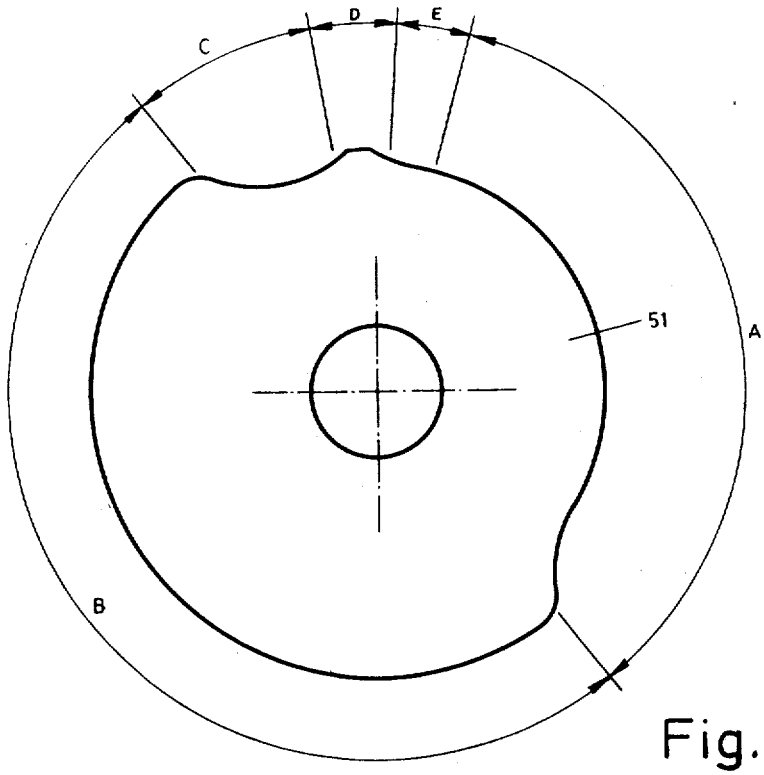
FIG. 7 illustrates a control cam of the counter-holder of the conveyor device.
Figure 8:
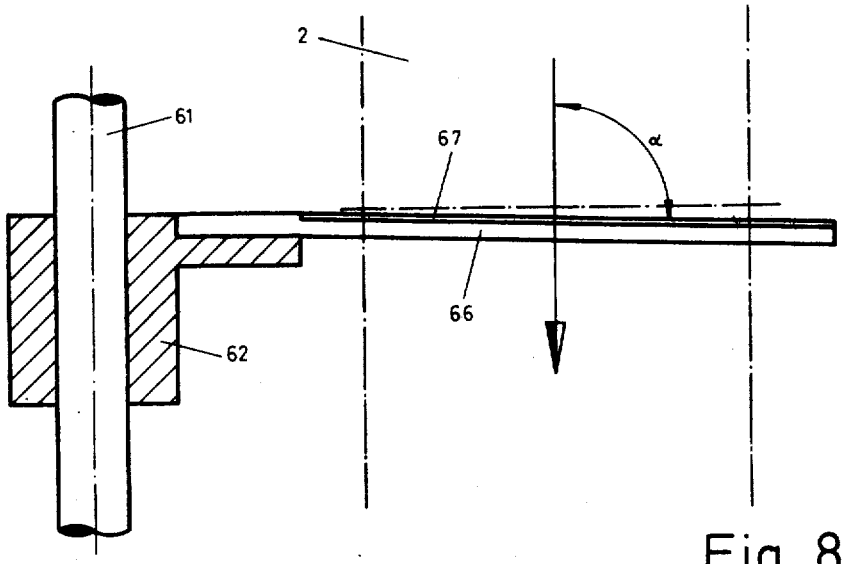
FIG. 8 is a cross-sectional view showing details of the cutter, the section being taken substantially along the line VIII—VIII of FIG. 2.

The cam disk or cam 51 serving to control the counter-holder 46 will be considered more fully in conjunction with FIG. 7. During the working phase A the long section of the material web is conveyed with the counter-holder applied thereto and this conveying occurs directly after the cutting of the short section. As soon as the conveying action has stabilized, the counter-holder is retracted during the working phase or step B and only at the end of the conveying of the long section during the working step or phase C is such counter-holder reapplied. At the end of this working phase C there also occurs the cutting of the long section. The suction operation, if desired, can already begin during the working phase C in order to prevent variations or deviations of the overlapping width X. The suction nozzle 19 however does not fixedly retain the long section since the applied counter-holder 46 assumes the function of further conveying the section by means of the conveyor device 10. During the working phase or step D the long section is held by the suction nozzle 19 while at the same time the counter-holder 46 is lifted-off, in order to prevent the engagement of the section by the conveyor device 10 and to render possible the infeed of the material web end in the desired overlapping width X. If there has been reached this overlapping width X — which is the case at the end of the working phase D — then the negative pressure applied at the suction nozzle is annihilated, resulting in release of the long section. At the same time the counter-holder is pressed on and during the working phase or step E there is further conveyed the desired length of the short section together with the long section. At the end of this working phase or step there occurs the cutting of the short section and a new work cycle can begin.

The cutter device 11 possesses a holder 60 secured to a shaft 61 which is connected via a conventional and therefore not particularly illustrated pair of bevel gears with an intermediate shaft 62. This intermediate shaft 62 is operatively connected via further bevel gears 63 and 64 with the shaft 64a which, in turn, is coupled via the bevel gears 52 and 53 with the drive shaft 23. The holder 60 rotates at a rotational speed proportional to the rotational speed of the remaining units of the apparatus. The holder 60 contains two knives or cutters 65 and 66 serving for cutting the short sections and the long sections from the material web. The cutters 65 and 66 are fixedly connected with the holder 60 and arranged such that their edges penetrate the material web at an angle with respect to the material web plane. In order to realize a straight cut the cutting edges 67 of the cutters 65 and 66 are located at an angle $\alpha$ with respect to the direction of travel of the material web. The size of this angle is dependent upon the speed of travel of the material web and the cutting speed of the revolving cutters.

Having now had the benefit of the foregoing discussion the function of the apparatus will be considered in detail and is as follows:

The withdrawal device 9 continuously withdraws the material web 2 at a constant speed from the braked supply roller or roll 1 and delivers such to the conveyor device 10. At best seen by referring to FIG. 7, during the working plane A, the counter-holder 46 is pressed against the conveyor band 40 in order to stabilize the infeed of the material web 2. During the working phase B the counter-holder 46 is retracted and the material web can freely run into a not particularly illustrated slot located below the conveyor trough 15. During the working phase C the counter-holder 46 is again brought to bear at the conveyor band 40 and there occurs the cutting of the section by means of the cutter 66. Thereafter during the working phase D the cut long section is fixedly retained by means of the suction nozzle 19 and the counter-holder 46 is briefly opened. The section is thus released from the conveyor band 40 and while overcoming the residual frictional force of the conveyor band 40 fixedly held and the material web end can travel over the fixedly held section. If the desired overlapping region X has been reached then the counter-holder 46 is again closed and presses the long section as well as the overlapped region against the conveyor band 40, during the working phase or step E. After reaching the desired length of the short section, there occurs at the end of the working phase E the cutting of the short section by means of the rotating knife or cutter 65, whereupon the work cycle begins anew with the working phase or step A. Immediately after completion of the overlapping of the long section and the short section the cigarette stack 16 is conveyed in the conveyor trough 15 towards the material web section extending over the conveyor trough 15, so that the sections are placed over the cigarette stack. The placement of the sections around the stack and the folding thereof is part of the state-of-the-art and does not constitute part of the invention, so that there is no need to further consider the same.

Continuing, in contrast to the illustrated exemplary embodiment it is to be expressly understood that modifications thereof are readily possible. Thus, for instance, in FIGS. 9 and 10 variations of the control device 13 are shown. The control device, indicated by reference character 13a in FIG. 9, contains a longitudinal slide 70, the movable slide component 71 of which is pre-based by means of a spring 72 in one terminal position. The movable slide component 71 possesses a plunger 73 which coacts with a cam disk 74. This cam disk 74 is connected with the drive components of the apparatus, for instance with the drive shaft 23. In the terminal position which is brought about by the action of the spring 72 a connection or communication channel 75 of the movable slide component 71 establishes a flow communication between the connection 28 flow communicating with the suction nozzle 19 and a vent channel 76. The cam 77 of the cam disk 74 moves the movable slide component or portion 71 into a work position in which the connection channel 75 flow communicates the connection 28 to the suction nozzle with the connection 27 to the negative pressure or vacuum source.

Figure 9:
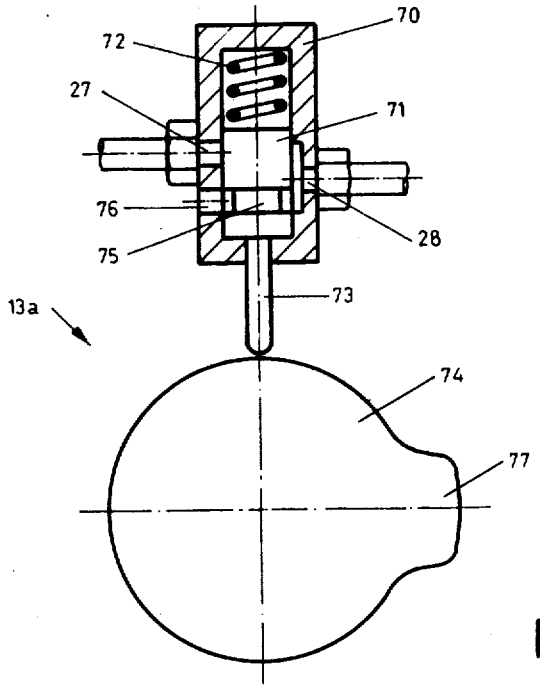
FIG. 9 illustrates a further embodiment of control device for the holder device employing a longitudinal slide valve or slide arrangement.
Figure 10:
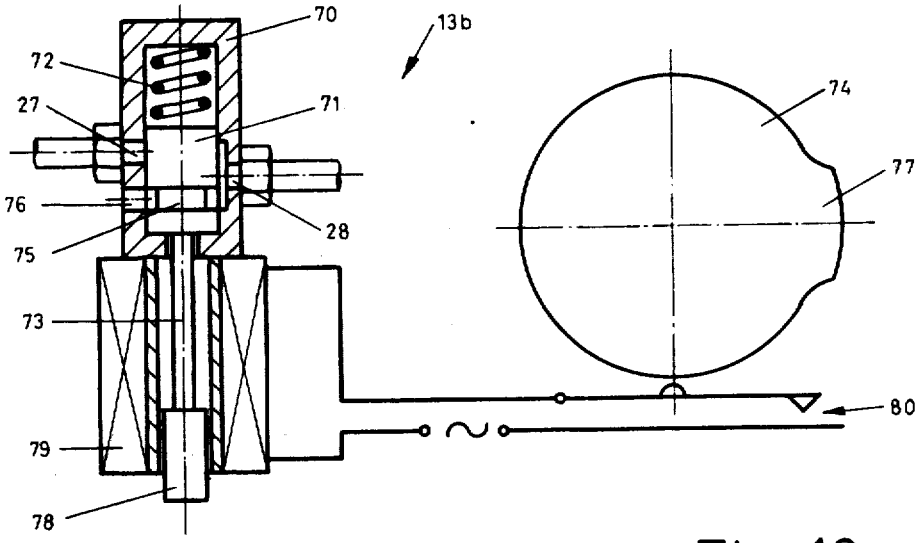
FIG. 10 illustrates a still further embodiment of control device for the holder device employing an electromagnetic longitudinal slide valve arrangement.

As to the control device 13b of FIG. 10 such also contains a longitudinal slide which, in contrast to the control device 13a of FIG. 9, is not directly moved by the cam disk 74, rather is electromagnetically constructed. The movable slide component or portion 71 is connected with the core 78 of a coil 79. In order to activate the coil 79 there is provided a pair of contacts 80 which cooperate with the cam disk 74 and are closed by the cam 77. The function of this construction of longitudinal slide or slide valve arrangement is analogous to that of the embodiment of FIG. 9.

Still further modifications of the invention are possible without departing from the spirit and scope of the inventive concepts. Thus, for instance, the counter-holder 46 could again be pneumatically actuated and the control device 13 can simultaneously serve to control the counter-holder. Also it would be possible to have an electromagnetic actuation of the counter-holder 46, wherein the control would occur via a cam disk and contacts comparable to the embodiment of FIG. 10.

Additionally, it would be possible, instead of providing rotating cutters 65 and 66, to equip the cutter device with a pneumatically or electromagnetically actuated cutter, the control of which, for instance, could be carried out likewise with the aid of the control device 13 or analogous to the variant embodiments of FIGS. 9 and 10.

The novel apparatus for the cutting of sections of a material web and for overlapping in each case two sections manifests itself through its exceedingly simple and operationally reliable construction. Since the material web is continuously payed-off or withdrawn at a constant speed, there is realized a considerable simplification of the apparatus in contrast to the state-of-the-art structures, coupled with a simpler adjustment of the apparatus and less susceptibility to wear. Moreover, there is beneficially realized a notable increase in the efficiency or output of the apparatus since the material web to be payed-off is not subjected to any alternating acceleration- and deceleration forces. Thus, for instance, it is possible with a conventional packaging machine for cigarettes to increase the maximum output from 160 packs per minute to 200 and more cigarettes packs or packages per minute.

While there is shown and described present preferred embodiments of the invention, it is to be distinctly understood that the invention is not limited thereto, but may be otherwise variously embodied and practiced within the scope of the following claims. Accordingly,

What is claimed is:

1. Apparatus for severing sections of a material web and for overlapping the severed sections in pairs, especially for a packaging machine for the packaging of products which can be smoked, comprising a supply roll for supplying a material web, a withdrawal device for withdrawing the material web from the supply roll, a cutter device for cutting sections from the material web, a conveyor device for conveying the cut sections, a holder device comprising a suction nozzle arranged between the cutter device and the conveyor device adjacent the plane of travel of the material web, a control device comprising a pneumatic valve for operating the holder device by control of the application of suction through said nozzle such that said holder device fixedly holds a cut section for overlapping the same until the material web which continuously moves has displaced over the fixedly held cut section by an amount corresponding to a predetermined overlapping width, said pneumatic valve including means to vent said suction nozzle to atmosphere after fixedly holding said cut portion to precisely control said overlapping width.

2. The apparatus as defined in claim 1, wherein said suction nozzle includes an infeed portion which is directed away from the path of the material web to ensure that the trailing edge of said cut section is drawn clear of the path of said continuously moving web as overlapping occurs.

3. The apparatus as defined in claim 1, wherein the holding force of the holder device is greater than the frictional force of the conveyor device engaging at the cut section.

4. The apparatus as defined in claim 1, wherein the control device comprises slide means, drive means for said slide means, a connection channel in said slide means which can be opened for fixedly holding a cut section, and means defining a supply of negative pressures, said connection channel being arranged between the suction nozzle and said negative pressure supply means.

5. The apparatus as defined in claim 4, wherein said slide means includes a vent channel in order to vent the suction nozzle to atmosphere after fixedly holding the cut section.

6. The apparatus as defined in claim 4, wherein said slide means comprises a rotary slide valve arrangement incorporating a stationary slide component having a connection for the negative pressure supply means and a connection for the suction nozzle, a rotating slide component cooperating with said stationary slide component, said drive means being arranged to drive said rotating slide component, said rotating slide component comprising a substantially ring-shaped channel which, during rotation of the rotating slide component, is continually in communication with the connection for the negative pressure supply means, and a substantially arcuate-shaped connection channel operatively connected with the ring-shaped channel such that said arcuate-shaped connection channel can be periodically brought into flow communication with the connection for the suction nozzle.

7. The apparatus as defined in claim 6, wherein the rotating slide component — viewed in the direction of rotation — possesses a substantially arcuate-shaped vent channel arranged behind the connection channel such that said arcuate-shaped vent channel can be periodically brought into flow communication with the connection for the suction nozzle.

8. The apparatus as defined in claim 4, wherein said slide means comprises a longitudinal slide having a movable slide component, and a cam disk operatively connected with said drive means, said movable slide component bearing against said cam disk.

9. The apparatus as defined in claim 4, wherein said slide means comprises an electromagnetically operated structure, said connection channel establishing a flow connection between a connection for the suction nozzle and a connection for the negative pressure supply means in a work position of said electromagnetically operated slide means, and a contact means operatively connected with said drive means for energizing said electomagnetically operated slide means.

10. The apparatus as defined in claim 1, wherein said conveyor device is provided with a counter-holder, said conveyor device including conveyor elements, said counter-holder being adapted to press the material web and the sections respectively, against said conveyor elements, and means for lifting-off said counter-holder at least during the overlapping operation.

11. The apparatus as defined in claim 10, wherein the counter-holder comprises a revolving band having raised portions for conveying the material web and depressions for non-positively conveying the material web.

12. The apparatus as defined in claim 10, wherein said lifting-off means includes lever drive means for operating the counter-holder, a cam disk and, drive means for operating said cam disk, said lever drive means being actuated by said cam disk.

13. The apparatus as defined in claim 1, wherein the cutter device comprises at least one cutter having a cutter edge for penetrating the material web at an angle to the material web, said cutter being adjusted as a function of the material web travel speed and the cutting speed at an angle to the direction of travel of the material web such that the sections are cut at right-angles to the material web.

14. The apparatus as defined in claim 13, further including a rotating shaft at which there is fixedly arranged the cutter.

15. The apparatus as defined in claim 1, wherein said apparatus is arranged to cooperate with a packaging machine for cigarettes.

16. The apparatus as defined in claim 1, wherein said apparatus is arranged to cooperate with a packaging machine, said apparatus being adapted to deliver the material web sections for the inserts of a package.

17. An apparatus for severing sections of a material web and for overlapping in each case two such sections, especially for a packaging machine for the packaging of products which can be smoked, comprising supply means for continuously supplying a material web, withdrawal means for withdrawing the material web from the supply means, cutter means for cutting sections from the material web, conveyor means for conveying the cut sections, pneumatic suction holder means arranged between the cutter means and the conveyor means, and control means for controlling the application of suction to said holder means, said holder means being adapted to fixedly hold a cut web section for overlapping the same with the material web until the continuously moving web has been displaced over the fixedly held cut section by an amount essentially corresponding to a predetermined overlapping width, said control means including means to vent said pneumatic suction holder to atmosphere after fixedly holding said cut portion to precisely control said overlapping width.

18. The apparatus as defined in claim 17 wherein said pneumatic suction holder means includes a surface adjacent the path of said continuously moving web, the infeed portion of said surface being directed away from the path of the material web to ensure that the trailing edge of said cut section is drawn clear of the path of said continuously moving web as overlapping occurs.

* * * * *